US005508483A

United States Patent [19]

Czarn et al.

[11] Patent Number: 5,508,483

[45] Date of Patent: Apr. 16, 1996

[54] HIGH PRESSURE SWITCH APPARATUS

[75] Inventors: David A. Czarn, Cumberland, R.I.; Stanley G. Homol, Taunton, Mass.

[73] Assignee: Texas Instruments Incorporated, Dallas, Tex.

[21] Appl. No.: 409,772

[22] Filed: Mar. 24, 1995

[51] Int. Cl.[6] ..... H01H 35/34

[52] U.S. Cl. ..... 200/83 J; 200/83 P; 200/279

[58] Field of Search ..... 92/5 R, 98 R; 73/723, 745, 861.47; 340/626; 307/118; 200/302.1, 275, 279, 82 R, 83 R, 83 N, 83 J, 83 P, 83 Y

[56] References Cited

U.S. PATENT DOCUMENTS

| | | | |
|---|---|---|---|
| 3,497,652 | 2/1970 | Horn et al. | 200/279 |
| 4,616,114 | 10/1986 | Homol . | |
| 4,757,165 | 7/1988 | Marcoux et al. | 200/83 P |
| 4,794,214 | 12/1988 | Sanford | 200/83 P |
| 5,015,808 | 5/1991 | Czarn et al. | 200/83 P |
| 5,049,708 | 9/1991 | Strasser . | |
| 5,278,367 | 1/1994 | Baker . | |

*Primary Examiner*—Gerald P. Tolin
*Attorney, Agent, or Firm*—Russell E. Baumann; Richard L. Donaldson; René E. Grossman

[57] ABSTRACT

A high pressure switch (10) is shown having a housing member (12) with an orifice (22) extending from a first end (18) to a recess (24) formed in a surface (26) in a central portion (14) of the housing. A sidewall (28) extends from surface (26), leaving a shoulder around the recess, forming a cavity (32). An annular support plate (34) is received on the shoulder of surface (26) capturing a flexible membrane (36) which closes recess (24) to form a pressure chamber. An eyelet (40) is disposed contiguous to the support plate (34) and is locked in place by deforming the outer distal portion (30) of wall (28) radially inwardly over the outer periphery of eyelet (40). A terminal (44) is mounted on eyelet (40) but electrically isolated from the outer ring of eyelet (40) by electrically insulating material (46). A pressure/force converter in the form of a piston (58) is received in the bore of annular support plate (34) and is provided with a circular force transfer rib (64) adapted to transfer force to an electrically conductive, snap acting disc (50) upon the occurrence of a selected level of pressure in orifice (22). Snap acting disc (50) is disposed on a disc seat (48) formed in eyelet (40) and captured there by projections (54) formed above the disc seat (48). Disc (50) normally is out of engagement with a stationary contact (52, 52') when in a non-actuated configuration but is adapted to form an electrical path between the stationary contact (52, 52') and the housing (12) when the disc (50) snaps to its actuated configuration.

8 Claims, 2 Drawing Sheets

HIGH PRESSURE SWITCH APPARATUS

FIELD OF THE INVENTION

This invention relates generally to pressure responsive electrical switches for sensing fluid pressure and more particularly to such switches used in high pressure applications such as automotive power steering or brake systems.

BACKGROUND OF THE INVENTION

It is conventional to place pressure responsive switches in communication with automotive hydraulic fluid systems, for example, to provide signals to the powertrain control module (PCM) responsive to the power steering demand so that engine speed can be increased when required to prevent stalling.

A prior art switch system used for this purpose is mounted in a power steering fluid pump and includes a piston slidably disposed in a port which extends from the high pressure side of the pump. A stationary electrical contact is disposed in alignment with the piston in a switch chamber and a second electrical contact is mounted on the end of the piston adjacent to the stationary electrical contact. The piston is normally spring biased away from the stationary electrical contact and is adapted to move into engagement with the stationary contact when the pressure of the fluid increases to a certain level. The fluid which communicates with the piston also is received in the switch chamber so that the contacts move into and out of engagement submersed in the fluid.

This prior art switch system has several limitations including a problem with dirt and contaminants in the fluid which, over time, tend to get between the contacts and interfere with the electrical switching function. Another problem relates to the tendency of the switching level calibration to shift over the life of the device due to friction of the piston in the port. Yet another problem is the low level of contact force which exists at pressures close to the actuation pressure.

U.S. Pat. No. 5,278,367, assigned to the assignee of the present invention, discloses a switch system which overcomes the above noted limitations. In the patent, a piston is shown slidably received in a port formed in the power steering fluid pump. The piston extends into a switch body and has an end disposed in the switch chamber adjacent a switch assembly. The switch assembly comprises a current carrying snap acting disc movable between opposed concave/convex dished configurations. The disc is mounted on an annular disc seat and a stationary electrical contact is mounted in alignment with the center of the disc and located at a selected location within the movement of the disc with the disc providing a selected switching point and hysteresis. A flexible diaphragm disposed between the disc and the piston and sealed with a resilient o-ring between the diaphragm and the switch body prevents the hydraulic fluid from entering the switch chamber.

Although the switch system made in accordance with the patent is very effective, it requires the provision of a precision machined port in the fluid pump housing to receive the piston, as well as an access port to return bleed-by fluid to the low pressure side of the pump which adds to the expense of the pump assembly and makes it unsuitable for certain low cost applications and/or applications where, for one reason or another, it is preferred not to locate the switch in the pump housing.

Another limitation of the switch system of the referenced patent is that the longevity of the snap acting disc member in some applications is adversely affected due to high bending stresses imparted to the disc member as a result of the high pressure fluid pump systems.

It is an object of the present invention to provide pressure responsive electrical switch apparatus which can, in effect, be plugged into the hydraulic system at any convenient location. Another object is the provision of such a switch which has improved longevity and is useful with relatively high temperatures and high vibration levels, which is relatively inexpensive yet rugged and reliable.

Briefly, in accordance with the invention, a high pressure fluid responsive electric switch comprises a housing member formed of steel or other suitable material capable of withstanding high fluid pressure. The housing member has a first threaded end projecting from a central portion with a port or orifice formed through the threaded end extending into a recess formed in the central portion. A shelf is formed around the recess and a cavity is defined by sidewalls extending downwardly from the shelf. An annular support member of steel or the like is received in the cavity capturing a flexible membrane formed of polyimide or the like between the annular support and the shelf forming a fluid chamber in the housing member. The annular support is in turn captured in the cavity by an eyelet formed of an outer ring of steel or other suitable material capable of withstanding the pressures without changing its dimensional configuration, and a terminal post separated from the outer ring by suitable electrically insulating material, such as plastic or glass, in a known manner. The distal free end of the sidewall is deformed inwardly over the ring portion of the eyelet to securely mount the eyelet to the housing. The ring, at its upper side is formed with a disc seating surface spaced along the longitudinal axis of the ring above a distal end of the terminal post and insulating material. A snap acting disc is disposed on the seating surface and is adapted to snap into and out of engagement with a stationary contact on the distal end of the terminal post. A pressure/force converter in the form of a piston element is received in the central opening of the annular support member and has a first end in engagement with the membrane and an opposite second end in engagement with the snap acting disc member. According to a feature of the invention the second end of the piston is formed with a circular force transfer rib having a diameter selected to amplify to a selected level the pressure required to cause the disc to snap from an upwardly convex configuration out of engagement with the stationary contact. According to another feature of the invention, the stationary contact is also formed of a generally circular rib adapted to engage the disc, when it snaps to its opposite configuration, at a location spaced radially outwardly from the center of the disc to reduce the moment arm on the disc between the force converter rib and the location of engagement with the stationary contact. According to a feature of a modified embodiment of the invention, the surface area of contact engagement is reduced by forming the circular rib of the stationary contact into segments, i.e., discontinuous such as a castellated rib.

These and other advantages and features of the invention will become apparent from the following description of preferred embodiments of the invention with reference to the accompanying drawings.

DETAILED DESCRIPTION OF PREFERRED EMBODIMENTS

Figure 1:
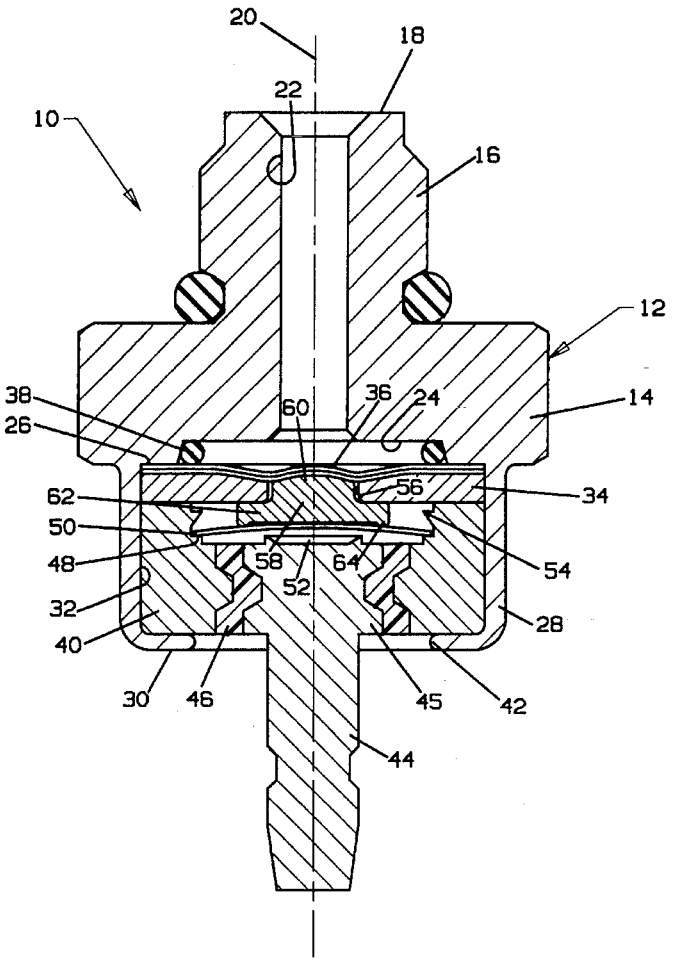
FIG. 1 is a cross sectional view taken through a switch shown in the unactuated condition made in accordance with the invention.

With reference to FIG. 1, a fluid pressure responsive electric switch 10 made in accordance with the invention comprises a generally cylindrical housing 12 formed of suitable electrically conductive material such as brass having a central portion 14, preferably formed with a hexagonally configured outer periphery to facilitate installation and removal via thread 16 formed on a first housing end 18 extending from central portion 14 along a longitudinal axis 20. An orifice 22 is formed through end 18 and extends into a recess 24 formed in a first surface 26 of central portion 14, recess 24 forming a pressure chamber to be discussed below. A sidewall 28 extends from first surface 26 toward a second end 30 of housing 12 to form a switch cavity 32 and leaving a shoulder on surface 26 around the periphery of recess 24.

A generally annular support plate 34 is disposed in cavity 32 and received on the shoulder on surface 26 with a flexible membrane 36 of suitable material such as polyimide or the like (two layers being shown but the number of layers being a matter of choice) being disposed intermediate support plate 34 and surface 26. A suitable resilient gasket, such as o-ring 38 is also received in recess 24 to form a fluid tight seal.

An eyelet 40 having an outer ring formed of electrically conductive material is disposed in cavity 32 in alignment with the shoulder on surface 26 with the eyelet and support plate locked in place by deforming the distal end of wall 28 radially inwardly as shown at 42. Eyelet 40 mounts an elongated electrically conductive terminal post 44 but electrically isolated therefrom by suitable electrically insulative material, such as plastic 46, in a known matter. If desired, supplemental potting material may be placed over the external surface of eyelet 40, plastic 46 and outer peripheral portion of flange 45 of terminal post 44 to minimize fluid leakage along the interface of the plastic and melted surfaces.

Terminal post 44 has a longitudinal axis coaxial with axis 20. An annular disc seat 48 is formed on eyelet 40 spaced along axis 20 above terminal post 44 and glass 46 and receives thereon a stiff, electrically conductive, snap acting disc 50 movable between an upwardly convex configuration shown in FIG. 1 and an opposite, upwardly concave configuration shown in FIG. 2 when subjected to a sufficient level of force on the top surface of the disc as seen in the figures as will be discussed below. A stationary electrical contact 52 is disposed on the inner distal end of terminal post 44 and is preferably shaped as an upstanding circular rib as will be discussed below. After placing disc 50 on seat 48 spaced portions 54 of eyelet 40, if desired, maybe staked or deformed inwardly above the disc seat 48 to prevent disc 50 from being dislocated during the assembly procedure while still permitting the disc to "float" on its seat.

Support plate 34 is formed with a centrally disposed bore 56 having longitudinal axis generally coincident with axis 20 and which receives therethrough a pressure converter piston 58 having a first diameter portion 60 slidingly received in bore 56 and a second larger diameter portion 62 which forms a stop surface so that the top surface piston 58, as seen in FIG. 1, generally forms a smooth surface with the top surface of support plate 34. The top surface of support plate 34 adjacent bore 56 is tapered downwardly while the top surface of piston 58 is formed with a generally upwardly convex shape in order to promote so-called wetting action of membrane 36 with the underlying surface area to optimize repeatability in converting fluid pressure received in orifice 22 to a force on disc 50.

A generally circular force transfer rib 64 is formed on the bottom surface of piston 58 and is adapted to engage the top surface of disc 50 in order to transfer force to the disc.

Fluid pressure received in orifice 22 acts on membrane 36 and piston 60 applying a force on disc 50 through circular rib 64. When the force applied to disc 50 exceeds the instability level of the disc, the disc will snap into the FIG. 2 position in engagement with stationary contact 52 to thereby complete an electrical circuit between terminal 24 and a grounded housing 12.

The diameter of annular force transfer rib 64 is chosen to provide the desired amplification ratio of disc force to the fluid pressure at which the switch is to actuate. The height of the rib is selected to be sufficient so that the center of the disc, when in the upwardly convex position, does not contact the body of piston 58 when the disc nears its snap point.

An electrical switch of the type disclosed herein in which snap acting disc moves from one dished configuration to an opposite dished configuration to engage a stationary electrical contact has no significant wiping action between the disc and the stationary contact. In order to minimize the influence of contaminant particles on switching action it is desirable to minimize the surface area of that portion of the stationary contact which engages the disc. For example, as shown in FIG. 3, a centrally disposed generally spherical stationary contact 66 having a relatively small radius provides an effective contact; however, this type of contact results in relatively high bending stresses developed in the snap acting disc which serves to limit the useful life of the disc by causing changes in the calibrated set point of the disc, i.e., the force at which the disc will change from the FIG. I to the FIG. 2 configurations, as well as lowering fatigue life of the disc. As seen in FIG. 3, this type of contact, when used with a pressure converter having a force transfer rib, results in a relatively large moment arm 1 between contact 66 and rib 64 with the disc 50 being subjected to relatively large center deflection as seen by the dashed lines with a relatively high bending stress resulting. In some applications the use of a central stationary contact may be acceptable based on the conditions of the application, i.e., the pressure levels, the desired numbers of cycles the disc will undergo during the expected life of the switch, the pressure force conversion established by converter 58 as well as the elastic limit of the disc.

Figure 2:
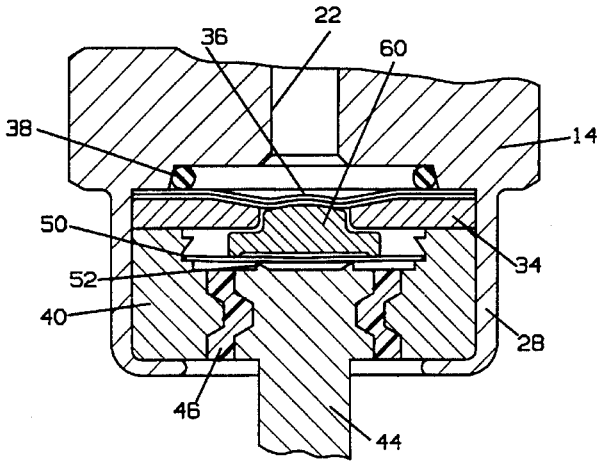
FIG. 2 is a broken away sectional view of FIG. 1 showing the switch in the actuated conditions
Figure 3:
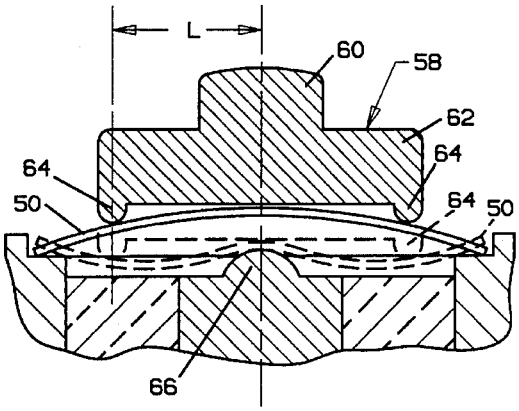
FIG. 3 is an enlarged cross sectional view of a portion of a switch having a pressure converter in engagement with an electrically conductive snap acting disc in which a stationary contact surface is disposed in alignment with the center of the snap acting disc.
Figure 4:
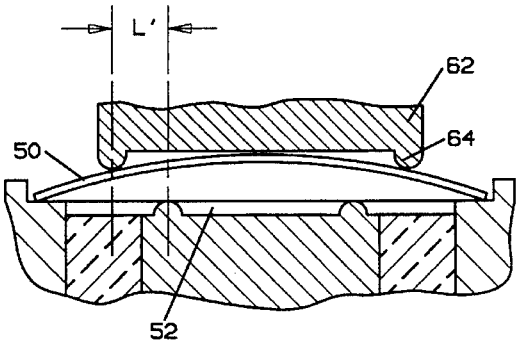
FIG. 4 is a view similar to FIG. 2 showing an improved stationary contact for use with the pressure converter and snap acting disc.

According to a feature of the invention, the circular stationary contact 52 shown in FIGS. 1, 2 and 4 reduce the bending stress in the disc as well as maintain a relatively small surface area of contact engagement. As seen in FIG. 4, the moment arm 1' is minimized to thereby limit bending stress and significantly improve disc life expectancy. Although ideally, optimum results would be obtained if the diameters of force transfer rib 64 and stationary contact 52 were equal to one another so that all, or most, of the pressure applied to converter 58 would result in only compressive forces on the disc, from a practical standpoint related to spacing requirements for the switch components, e.g., the need for electrical isolation between terminal 44 and eyelet member 40, there is a limit as to how close one can get to 1=0 in a particular design.

Figure 5:
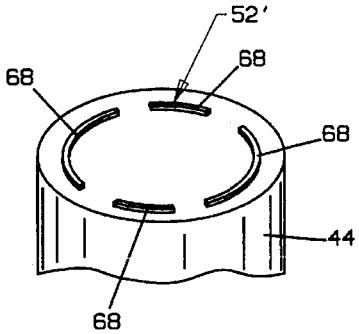
FIG. 5 is a perspective view of a modified stationary electrical contact useful in a switch made in accordance with the invention.

FIG. 5 shows a modification of the stationary contact 52' in which the circular contact rib is formed by discontinuous segments 68 to further reduce the surface area of contact engagement while still minimizing the moment arm.

It will be understood that various changes in the details, materials and arrangement of parts which have been illustrated in order to explain the nature of the invention, may be made by those skilled in the art within the principle and scope of the invention, as expressed in the appended claims.

What is claimed:

1. A pressure responsive electrical switch for use with a high fluid pressure source comprising:

a body member having a central portion and first and second end portions, a recess formed in the central portion forming a fluid pressure chamber, a shelf extending around the perimeter of the recess, an orifice extending between the first end portion and the recess, a generally cylindrical wall extending from the central portion to a distal end at the second end portion forming a switch cavity, a flexible, impervious membrane disposed on the shelf and extending over the recess, an annular support plate having a centrally disposed bore therethrough, the bore having a longitudinal axis, the support plate having an outer periphery received on the membrane in alignment with the shelf, a pressure/force converter having first and second diameter portions and having first and second ends, the first diameter portion slidably received in the bore of the support plate with the first end of the converter engaging the membrane, the second end of the converter formed with a circular motion transfer rib having a selected diameter, an electrically conductive annular disc support member having an outer periphery received on the outer periphery of the support plate, the distal end of the cylindrical wall being deformed radially inwardly to capture the disc support member, a disc seat formed on the disc support member, an elongated terminal member mounted on the disc support member and electrically isolated therefrom, the terminal having a distal end mounted in the switch cavity, a stationary electrical contact disposed on the distal end of the terminal member, an electrically conductive, generally circular snap acting disc having a center and being mounted on the disc seat and being movable between a first configuration out of engagement with the stationary electrical contact and a second configuration in engagement with the stationary electrical contact thereby forming an electrical path in the second configuration extending from the terminal member to the annular disc support member, the stationary electrical contact being located to engage the disc at a location of the disc spaced from the center of the disc.

2. A pressure responsive electrical switch according to claim 1 in which the stationary contact is configured as a generally circular rib having a selected diameter.

3. A pressure responsive electrical switch according to claim 2 in which the generally circular rib is discontinuous forming separated segments of a circle.

4. A pressure responsive electrical switch according to claim 2 in which the selected diameter of the circular rib is equal to or less than the selected diameter of the force transfer rib.

5. A pressure responsive electrical switch according to claim 1 in which the annular disc support member has a generally annular wall portion around the outer perimeter of the disc seat and the wall portion is deformed over spaced portions of the disc seat and spaced axially therefrom after the disc is received on the seat to loosely mount the disc as well as to prevent dislocation of the disc during assembly of the switch.

6. A pressure responsive electrical switch for use with a high fluid pressure source comprising:

a body member formed of electrically conductive material having a central portion with a first surface and having first and second end portions, a recess formed in the first surface forming a fluid pressure chamber, an orifice extending between the first end portion and the recess, the first surface forming a shelf around the recess, a generally cylindrical wall extending from the central portion to a distal end at the second end portion forming a switch chamber, an annular support plate having a centrally disposed bore therethrough, the bore having a longitudinal axis, the support plate having an outer periphery received on the shelf, a piston member having first and second diameter portions and having first and second ends, the first end and first diameter portion of the piston member slidably received in the support plate bore, the second end of the piston formed with a circular motion transfer rib having a selected diameter, a flexible, impervious membrane disposed between the support plate and the shelf, an electrically conductive annular disc support member contiguous with the support plate, the distal end of the cylindrical wall being deformed radially inwardly to capture the disc support member and annular support plate, a disc seat formed on the disc support member, a snap acting electrically conductive disc member having a center and being adapted to snap between a convex upward configuration and a concave upward configuration received on the disc seat, an elongated electrical terminal member mounted on the disc support member but electrically isolated therefrom, the terminal member having a longitudinal axis coaxial with the longitudinal axis of the support plate bore, the terminal member having a distal end aligned with the disc and spaced a selected distance along the longitudinal axis below the disc seat, and a stationary electrical contact disposed on the distal end of the terminal member, the stationary contact having a circular projection having a selected diameter extending from the distal end so that when the snap acting disc snaps to a concave upward configuration engagement of the disc and the stationary electrical contact will be along a circular line spaced from the center of the disc.

7. A pressure responsive electrical switch according to claim 6 in which the circular projection is discontinuous forming segments of a circle.

8. A pressure responsive electrical switch according to claim 6 in which the selected diameter of the circular portion is equal to or less than the selected diameter of the force transfer rib.

* * * * *